United States Patent [19]

Hoffmann et al.

[11] Patent Number: 4,488,591

[45] Date of Patent: Dec. 18, 1984

[54] CONTINUOUS BILLET GUIDE STAND

[75] Inventors: Rudolf Hoffmann, Krefeld; Adolf G. Zajber, Langenfeld, both of Fed. Rep. of Germany

[73] Assignee: Mannesmann Aktiengesellschaft, Duesseldorf, Fed. Rep. of Germany

[21] Appl. No.: 370,961

[22] Filed: Apr. 22, 1982

[30] Foreign Application Priority Data

May 2, 1981 [DE] Fed. Rep. of Germany ..... 3117500

[51] Int. Cl.[3] ..... B22D 11/128

[52] U.S. Cl. ..... 164/442; 164/448

[58] Field of Search ..... 164/442, 448, 484; 72/224, 225, 246

[56] References Cited

U.S. PATENT DOCUMENTS 3,538,980 11/1970 Galluci ..... 164/442

4,290,478 9/1981 Kagerhuber ..... 164/442

FOREIGN PATENT DOCUMENTS 1942782 12/1971 Fed. Rep. of Germany .

2939321 4/1981 Fed. Rep. of Germany ..... 164/448

*Primary Examiner*—Kuang Y. Lin

*Assistant Examiner*—Richard K. Seidel

*Attorney, Agent, or Firm*—Schwartz, Jeffery, Schwaab, Mack, Blumenthal & Koch

[57] ABSTRACT

During the continuous casting of preforms of large cross-section, considerable problems occur in the straightening region, because due to straightening, deformations are caused in the billet which has not yet solidified at the core. Therefore, in addition to the upper and lower straightening rollers additional lateral support rollers are provided, so that the billet is supported on all sides. For the purpose of space-saving incorporation in a multi-billet installation, the support rollers are mounted in swinging frames, which are moved by vertically raised cylinders. In order that the support rollers can be adapted to different billet dimensions, they are received within the fork-like swinging frames by vertically movable guide frames with roller supports inserted therein and able to be adjusted horizontally. Springs inserted in the swinging frames exert a continuous force in a vertical direction against the guide frames. Upon lowering of the upper straightening rollers, the pressure plates of the roller supporting beam bear against the guide frames, whereby an automatic adaptation to a new billet thickness is provided.

11 Claims, 4 Drawing Figures

CONTINUOUS BILLET GUIDE STAND

BACKGROUND OF THE INVENTION

The invention relates to a conveying and straightening machine adjoining the secondary cooling section of a continuous casting installation for billets of any cross-section, in particular for preforms or blooms of relatively large cross-section and varying billet dimensions, in which case in the straightening region the billet is enclosed on all sides by rollers, whereof the lateral support and guide rollers and preferably the upper straightening and conveying rollers are adjustable in the direction of the billet.

During the continuous casting for example of bars or slabs of steel, a billet is supported and guided by partially driven guide and driving rollers located above and below the billet. In this case, for the casting of continuous slabs it is known (German Patent Specification No. 1 942 782) that a continuous slab is supported on all sides at least in the part of the billet guide directly following the chill mould, whereby the danger of the occurrence of bulging, which is particularly great at this point and thus also longitudinal cracks and ruptures of the billet should be restricted. The lateral rollers provided beside the billet, which are not driven, are adjusted with a predetermined definite force against a fixed measure, which is intended to be sufficient to relieve the load on the billet shell on the wider upper and lower sides.

The casting of billets of greater thickness, in particular of preforms with large billet cross-sections above 200 mm on arcuate continuous casting installations involves special problems, since a plurality of different stresses occur in the billet at the time of straightening the non-solidified preform. The straightening forces are thus applied to the billet by the straightening unit following the billet guide, which unit also operates as a drawing-out unit, by way of the horizontal straightening rollers. In this case, deformations of the billet shell are caused. The deformations are noticeable due to undesirable changes of the cross-section and cracks, which show that it is advisable for the billet to be supported on all sides in the conveying and straightening machine by closed or partially closed roller rims. In the case of bloom or preform installations, this has not been done hitherto and even in continuous slab casting installations, supporting the billet on all sides is known solely directly below the chill mould, which in this case is intended to serve for preventing bulging due to the ferrostatic pressure.

Since, above all, in continuous preform or bloom casting installations, the billet formats change frequently, each adjustment to a different billet dimension thus also necessitates an adjustment of the billet guide including the conveying and straightening machine. If solely upper respectively inner horizontal rollers and lower respectively outer horizontal rollers are present, this measure causes no difficulties. As a rule, the lower respectively outer rollers are attached rigidly to the basic frame of the billet casting installation and the upper respectively inner rollers are moved to the new format by means of hydraulic cylinders, which are located above the billet in the roll stand. However, in the present case, when the billet is supported on all sides, lateral support or guide rollers mounted in the vertical axes of the pairs of rollers are also present and have to be taken into consideration accordingly. These support rollers must also be adapted to the new format.

It proves more difficult that in the case of preform installations, the conditions as regards space are very restricted, since normally two billets lie closely one beside the other. The solution provided by the prior art (German PS No. 1 942 782) for continuous slab casting installations, for the transverse or horizontal displacement of the lateral support rollers, is therefore unsuitable in the case of multiple billet continuous casting installations, because the shifting cylinders arranged horizontally require a very large amount of space, due to which the space-saving incorporation of a second billet located directly beside the latter is no longer possible. An adaptation of the support rollers to different thicknesses of billet is not provided in the known installation.

SUMMARY OF THE INVENTION

It is the object of the invention to provide the lateral support rollers of a conveying and straightening machine unit comprising closed roller rims, adjoining the secondary cooling stage of a continuous casting installation, in particular for preforms or blooms having a large dimension so that in the case of a space-saving construction of multiple-billet installations, a lateral support which is correct for each billet format can be achieved without great expenditure.

This object is achieved according to the invention due to the fact that the lateral support rollers are located in swingable frames, which in their operating position swung into the rod guide or into the straightening driver, assume a fixed horizontal end position, that the support rollers are mounted to move both horizontally as well as vertically within the swinging frames and that with the adjustment of the adjustable straightening rollers, the lateral support rollers are automatically adjusted to the thickness or lateral dimension of the new size of billet so that the vertically mounted support rollers engage each side of the billet with their spherical surfaces.

The swinging frames as mounting means for the support rollers and their adjusting means facilitating horizontal as well as above all vertical displacement are incorporated in the existing free spaces of a multiple-billet casting installation, without requiring additional space. In the swung-in end position, the support rollers are located opposite each other at a certain distance apart, which can then be adapted according to the casting programme, without further variation of the swung position, to the existing billet widths in the case of rectangular billets or to the respective widths over flats in the case of polygonal billets. Due to the support rollers able to move in two directions, the necessary degrees of freedom are provided in order to facilitate an adaptation to the respective depth of the billet to be supported, which in the swung-in position of the swinging frames takes place automatically, in that during adjustment of the straightening rollers by way of the beams supporting them, the lateral support rollers are adjusted vertically so far that in the adjusted position of the straightening rollers, the support rollers have simultaneously experienced such a displacement that they bear preferably centrally against the billet by the lengths of their spherical surfaces and completely or partially engage each supported side of the billet.

A preferred embodiment of the invention provides that the swinging frames are constructed in the form of forks and receive vertically movable guide frames for roller supports inserted therein and able to be adjusted horizontally and that inserted in both fork arms are springs which exert a constant force in the vertical direction against the guide frames. In the swung-in end position, the swinging frames accordingly assume an inoperative position and the further adjusting movements are carried out with the guide frames and roller supports, which are inserted in an adjustable manner in the swinging frame solely carrying out a supporting function, in which case the guide frames which are under spring force are arranged to slide in the swinging frames and bring about the vertical displacement of the support rollers. In this case, with the largest size billet, under the vertically directed spring force, the guide frames project furthest from the swinging frames, which are located in the swung-in horizontal position with the upper edges of their frames below the line of the smallest billet format, whereas in the case of smaller billet dimensions, they are pushed more or less into the swinging frames against the force of springs by the sinking supporting beams of the straightening rollers. The horizontal adjustment is not influenced by this. On the contrary, separately adjustable roller supports are inserted in the guide frames. In the final effect, support roller arrangements are provided for carrying out the various adjusting movements and each consisting of three elements stacked one in the other, namely swinging frame, guide frame and roller supports.

For a better distribution of the forces acting on the guide frames, according to a further feature of the invention each fork arm comprises two springs, located between which is a bolt guiding the guide frame at the time of the vertical movement.

The invention further provides that servo-drives for the horizontal displacement of the roller supports are mounted in the guide frames and that spacer members able to be inserted in the guide frames and bearing against the outer ends of the roller supports define the width of the billet or the width over flats of a polygonal billet. The servo-drives may be constructed as threaded spindles which are connected to the roller supports and can be moved manually for example by plug-in hand cranks. However, it is also conceivable that hydraulically operated cylinders bring about the horizontal adjustment, in which case the precise retention of a desired billet width adjustment is achieved by spacer members which are inserted between the roller supports and guide frames.

According to one proposal of the invention, the lengths of the spherical surfaces of the lateral support rollers held by the roller supports are chosen depending on the largest billet dimension, whereby in any case a complete support for all existing billet thicknesses is provided.

One embodiment of the invention provides that at least two support rollers are arranged vertically side by side in the roller supports. One support roller of large diameter is thus replaced by two or more support rollers of smaller diameter, which produces an improved effect to counteract lateral bulging of the billet owing to the straightening forces.

The invention further proposes that the supporting beams of the adjustable straightening rollers bear against the guide frames by way of interchangeable pressure plates. The pressure plates project with respect to the straightening rollers and after an idle stroke push the guide frames downwards in a leading manner such that half a vertical displacement of the guide frames or of the lateral support rollers corresponds to an adjusting stroke of the straightening rollers determined by dimensions. Direct contact between the straightening rollers and the swinging or guide frames is precluded.

In order to facilitate the swinging movement it is provided according to the invention that preferably at the non-driven side of the straightening and conveying rollers, the swinging frames are provided with cross-pieces and are connected to the basic frame of the conveying and straightening machine and that pitch-operating cylinders raised vertically are arranged to oscillate on the basic frame, which cylinders act on the swinging frames. The upright arrangement of the pitch-operating cylinders, which can be chosen on account of the ability of the frames to swing, contributes to the fact that the lateral support roller adjustment requires no additional space.

According to a further proposal of the invention, preferably on the driving side of the straightening and conveying rollers, the swinging frames are connected by articulated levers to the basic frame of the conveying and straightening machine, whereby according to one embodiment of the invention it is provided that the movable articulated levers are pivoted in a parallelogram arrangement and that associated with the articulated levers is a control lever, which has a common mounting point with an articulated lever on the basic frame and is connected by its free end to a vertically raised pitch-operating cylinder. Due to the articulated lever swinging mounting, allowances are made for the spatial relationships on the driven sides of the straightening rollers, which are restricted on account of the driving spindles located at these points. Hereto the pitch operating cylinders are arranged in an upright manner. Fixing of the articulated levers or cross-pieces and in particular the pitch-operating cylinders to the basic frame is to be preferred, because a closed flow of forces thus exists, which does not allow any free forces and moments to occur. However, these parts are not precluded from being connected directly to the foundations, in which case the free forces and moments are then discharged into the foundations.

BRIEF DESCRIPTION OF THE DRAWINGS

One embodiment of a straightening and conveying machine according to the invention is illustrated in the drawings and in particular

DETAILED DESCRIPTION OF THE PREFERRED EMBODIMENT

Figure 1:
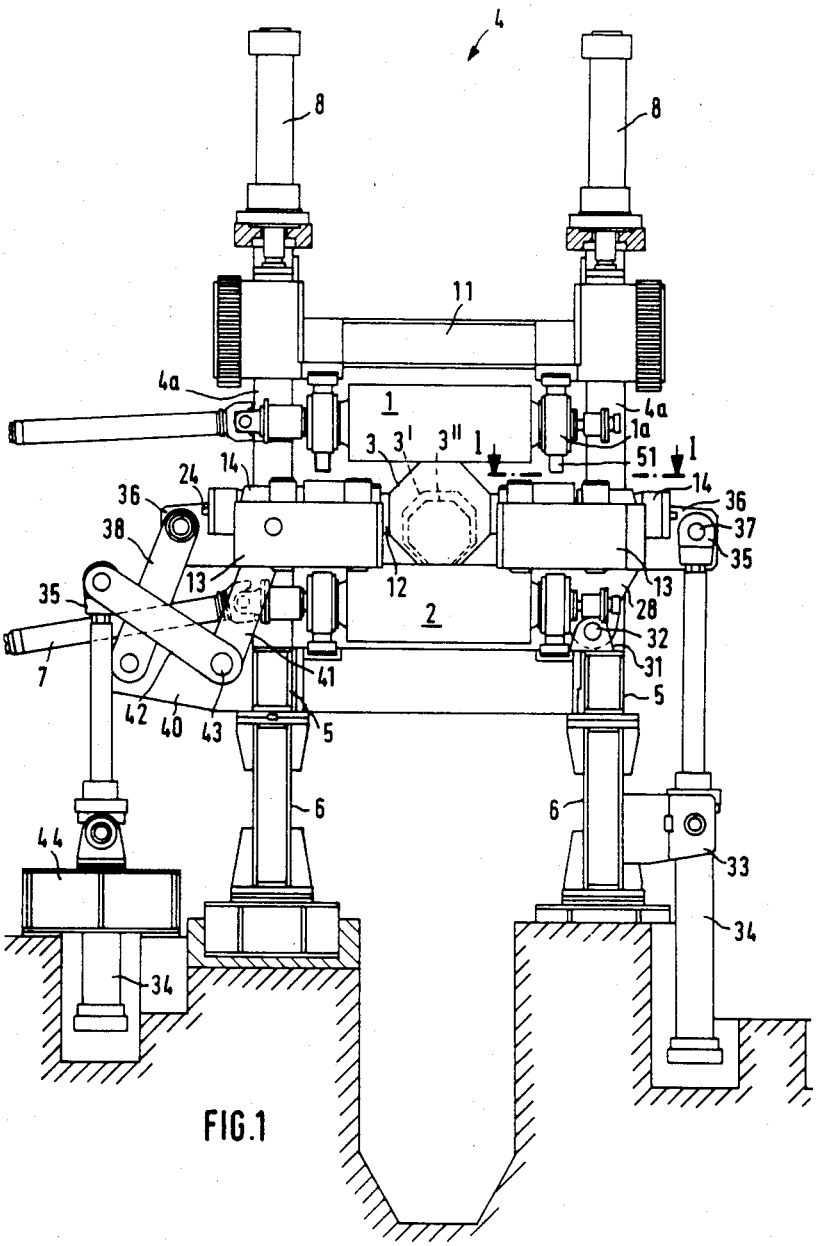
FIG. 1 is a front view of the conveying and straightening machine as a cross-section through a roll stand with driven straightening rollers and lateral support rollers.

FIG. 1 is a cut-away view of a straightening and driving machine unit 4 in the horizontal part of a curved continuous casting installation not shown in detail. The straightening and driving machine unit normally consists of a plurality of pairs of rollers following each other in the direction of travel of the billet, which are either mounted in a common stand or in individual stands. At least one of the partially driven straightening rollers is adjustable, in order to be able to convey billets of varying thickness, but also a starting billet which is thinner with respect to the cast billet. In FIG. 1, a cast octagonal billet 3 is guided between a driven upper straightening roller 1 and a driven lower straightening roller 2, the core of which billet is mostly still molten at this instant. The straightening rollers 1 are mounted in a billet guide stand 4*a*, which is attached to a basic frame 5. The basic frame 5 is mounted on foundation brackets 6 and is detachably connected thereto. The driving power for the straightening rollers is transmitted by drives (not shown in detail) by way of the driving spindles 7. The lower straightening roller 2 is mounted rigidly, whereas the upper straightening roller 1 is mounted in a supporting beam 11 and is pressed against the billet 3 with a pre-selected pressure by two hydraulic cylinders 8.

Figure 2:
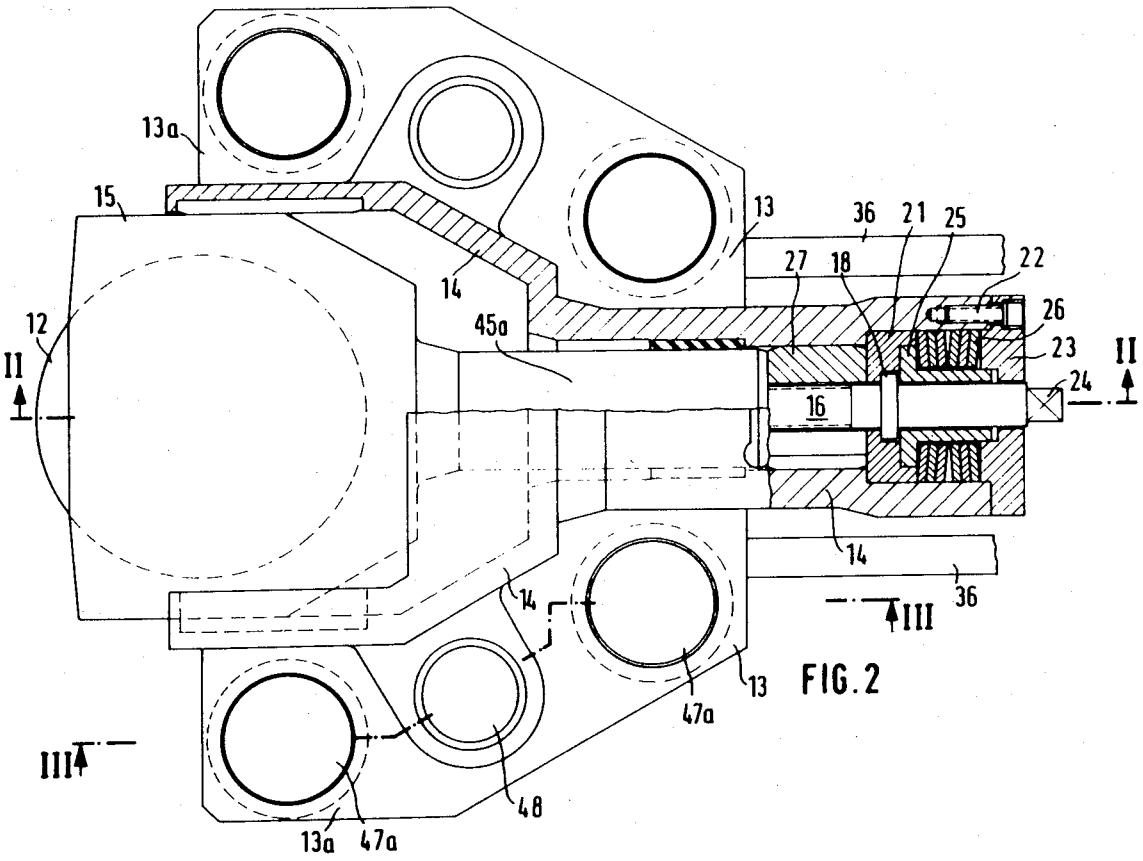
FIG. 2 is a plan view of a swinging frame according to the invention, approximately on line I—I of FIG. 1.

In order to avoid deformations when straightening large billets which are still molten at the core, a lateral support roller 12 is mounted on both sides in a swinging frame 13, in the vertical axis of the pairs of straightening rollers 1,2. The swinging frame 13 is constructed in the manner of a fork (FIG. 2) and serves as a support member for a guide frame 14 inserted in the swinging frame 13, which guide frame 14 in turn receives a roller support 15 as the actual mounting for the support roller 12. The roller support 15 is able to move horizontally in order to be able to adjust the lateral support roller 12 to the exact size of the billet.

Figure 3:
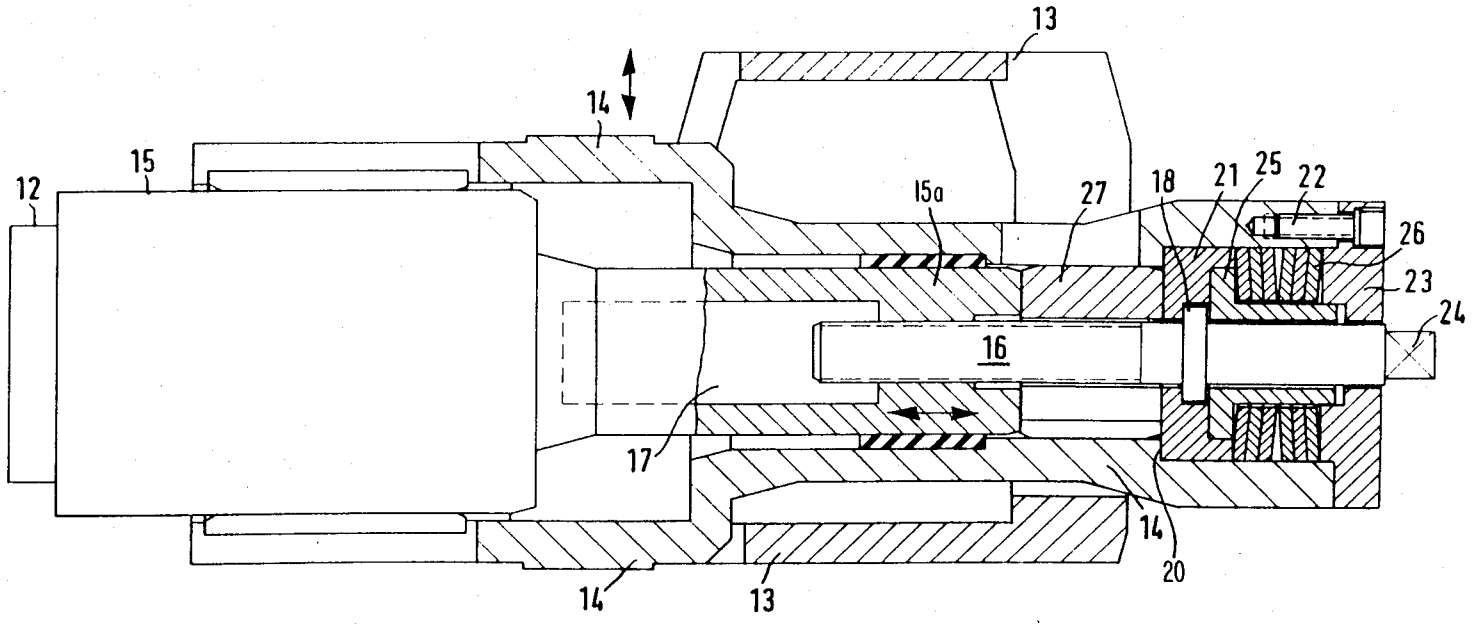
FIG. 3 is a partial section on line II—II of FIG. 2

The horizontal adjustment, which can be undertaken both in the swung-in as well as in the swung-out position of the swinging frame 13, takes place by way of a spindle 16, which extends through the base of the roller support 15 into a cavity 17 (FIG. 3). The end of the spindle is mounted in the guide frame 14 and at the time of rotation in the direction of the billet, a flange 18 of the spindle 16 comes to bear against an intermediate member 21 supported in the guide frame 14 against a projection 20. The guide frame 14 is closed by means of a cover secured by screws 22, through which only a square pin 24 of the spindle 16 projects. A hand wheel for adjusting the spindle may be located on the pin 24. The intermediate member 21 and the cover 23 enclose a bush 25 therebetween, which supports cup springs 26 and can be moved slightly in the axial direction until it bears against the cover 23. As the same time the bush 25 ensures the seating of the flange 18 in the intermediate member 21. Due to the described construction (FIG. 3) of the end of the guide frame 14 remote from the support roller 12, without any additional space requirement it is ensured that the support roller 12 always bears against the billet 3 due to the cup springs 26, but with a force of the cup springs 26 which is less than the transverse force resulting from the deformation. On the other hand, the deflection movement of the lateral support roller towards the outside is limited, so that due to the return movement no substantial variations of the width dimension of the billet are allowed. The lateral support rollers located opposite each other are adjusted to the width of the billet, which in the embodiment is the width over flats SW of an octagonal billet 3, in that first of all the roller supports 15 are adjusted to the billet. Then, a spacer member 27 exactly defining the respective billet dimension is inserted in the free space between the outer end of a roller support 15 and the intermediate member 21, in which case the spacer member 27 engages over the spindle 16. The spindle 16 is then turned back until the roller support 15 bears firmly against the spacer member 27.

In the case of a stand with exclusively non-driven straightening rollers 1,2 and on the side of the driven straightening rollers 1,2 free from drives (FIG. 1), the fork-like swinging frame 13 is mounted to swing in a manner such that on the one hand two narrow cross-pieces 28 extend from the swinging frame 13 to the basic frame 5. The cross-pieces 28 are mounted to rotate respectively in a support 31 by means of a shaft 32. On the other hand, a pitch-operating cylinder 34 is suspended to oscillate vertically in a projection 33 of the foundation bracket 6. The piston rod 35 of the pitch-operating cylinder 34 acts on two extensions 36 of the swinging frame 13, between which the piston rod 35 is secured by means of a bolt 37. In the operating position of the swinging frame 13, the latter assumes a horizontal position and the pitch-operating cylinder 34 is aligned vertically, so that a right angle is formed by the two parts (FIG. 1). When the swinging frame 13 is swung out, the cylinder 34 assumes a slightly inclined position in the suspension of the projection 33.

On account of the driving spindles 7 for the straightening rollers 1,2 extending on the driving side, the swinging frames 13 in these regions are constructed so that each swinging frame or its extensions 36 is connected by way of articulated levers 38,41 in a parallelogram arrangement to the extended support 40 of the lower, rigidly mounted straightening roller 12 (FIG. 1). A further lever comprises as the control lever 42 on the one hand a common mounting point 43 with a parallelogram lever 41 and on the other hand is connected to the piston rod 35 of the pitch-operating cylinder 34. The pitch-operating cylinder 34 is in turn suspended to oscillate vertically. The suspension is in this case located in a foundation base 44.

Figure 4:
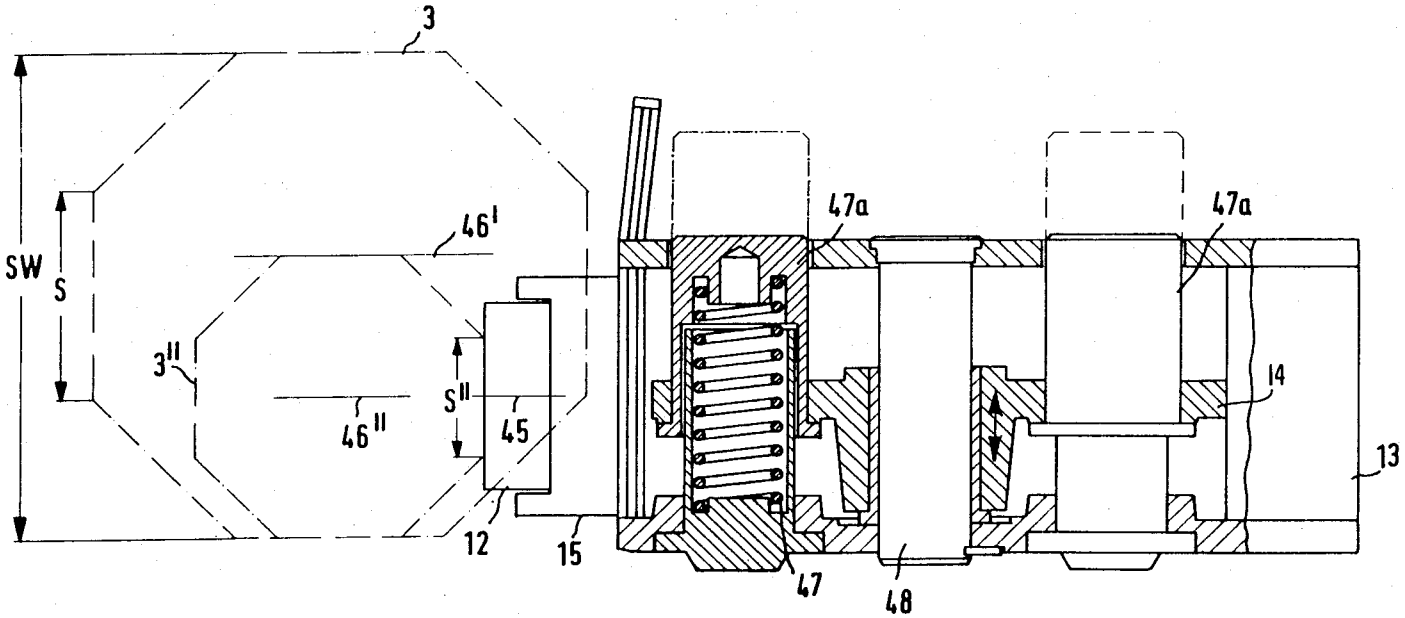
FIG. 4 is a partial section on line III—III of FIG. 2.

Due to the changing billet formats, of which the billets 3,3',3'' are shown in FIG. 1, not only must the aforedescribed adaptation of width take place, but on the contrary it is also necessary that the lateral support rollers 12, whereof the lengths of the spherical surfaces correspond to the largest lateral dimension S of the billet, are now also adjusted vertically so that a trouble free support is ensured. The vertical displacement is necessary in the case of large format changes. Previously the support rollers 12 could not be constructed to be so long that any billet format can be engaged without this vertical adaptation, because otherwise when adjusting the upper straightening rollers 1 to a smaller format, for example 3'', the straightening rollers 1 come into contact with the support rollers 12 projecting upwards, which must naturally be prevented. One strives to ensure that the entire supported height S or in the case of rectangular billets the entire thickness of a billet is supported. At best the transverse axes of symmetry 45 of the support rollers 12 are in line with the transverse axes of symmetry 46 to 46'' of the billet 3 to 3''. In order that this is possible without changing rollers, the guide frame 14 of a roller support 15 is subjected to a continuous spring force, for which purpose springs 47 are inserted in two cups 47*a* in each fork arm 13*a* of the swinging frame 13, which springs move the guide frame 14 out of the swinging frame 13 into its highest position. Bolts 48, which are inserted between the springs 47 in the swinging frame (FIG. 3) serve for guidance at the time of these adjustments. In the uppermost position of the guide frame 14, which is shown in dot dash line in FIG. 4, the largest billet dimension 3 is supported (FIG. 1). As soon as the format is changed to a smaller billet thickness or billet height, the upper straightening rollers 1 are lowered with their supporting beam 11 by way of the hydraulic cylinders 8 and bear by pressure plates 51, which can be arranged to be interchangeable for example in dove-tailed shoes (not shown in detail) of the bearing blocks 1*a* of the straightening rollers 1, against the guide frame 14. The latter is accordingly pushed down and drops with the roller support into its new position. FIG. 4 shows the guide frame 14 in its lowest position, in which the support roller 12 bears centrally against the side S″ of the billet 3″, i.e. the transverse axis of symmetry 46″ of the billet 3″ is in line with the transverse axis of symmetry 45 of the support rollers 12. It will be understood that when changing to the next larger billet format, the springs 47 are relieved of load when returning the supporting beam 11 and thus once more move the guide frame 14 automatically upwards.

What is claimed is:

1. A continuous billet guide stand for use in adjoining a secondary cooling section of a conveying and straightening machine in a continuous casting installation for billets of any cross-section, including blooms of relatively large cross-section and variable billet dimensions, said guide stand comprising:

an upper guide frame;

an upper horizontal guide roller mounted in said upper guide frame;

a lower guide frame;

a lower horizontal guide roller mounted in said lower guide frame;

means for vertically adjusting one of said upper and lower rollers to provide a vertically adjustable guide roller;

a pair of lateral support and guide roller structures, each of said support and guide roller structures comprising:

a vertically oriented lateral support and guide roller;

a roller support for mounting the lateral support and guide roller;

a lateral guide frame for guiding said roller support in a horizontal direction;

an adjusting device for adjusting the horizontal position of said roller support in said lateral guide frame; and means for adjusting the vertical position of said lateral guide frame in response to vertical adjustment of said vertically adjustable guide roller.

2. A continuous billet guide stand according to claim 1, wherein said lateral guide frame vertical adjustment means comprises a resilient support for said lateral guide frame, and abutting means arranged for vertical movement with said vertically adjustable guide roller, said abutting means being aligned with said resilient support for moving said adjustable lateral guide frame in response to movement of said vertically adjustable guide roller.

3. A continuous billet guide stand according to claim 1, wherein said lateral guide frame vertical adjustment means comprises a swinging frame receiving said lateral guide frame for vertical adjustment of said lateral guide frame along with said roller support, said horizontal adjusting device, and said lateral roller, and abutting means arranged for vertical movement in conjunction with said vertically adjustable guide roller, said abutting means being positioned for displacing said vertically adjustable lateral guide frame half the way of the adjusting movement of said vertically adjustable guide roller when said swinging frame is in a horizontal working position.

4. A continuous billet guide stand according to claim 3 wherein said abutting means is interchangeably mounted on said bearing block of said vertically adjustable guide roller.

5. A continuous billet guide stand according to claim 3, wherein said swinging frame comprises two forks receiving said lateral guide frame, and vertical bolts mounted in said forks for guiding said lateral guide frame vertically when said swinging frame is in a horizontal working position.

6. A continuous billet guide stand according to claim 5, wherein said upper guide roller is said vertically adjustable guide roller, and wherein biasing springs are mounted in said fork to assert a continuous force against said lateral guide frame to bias said lateral guide frame against the displacement produced by said upper guide roller.

7. A continuous billet guide stand according to claim 1, wherein said lateral support and guide roller has a spherical surface with a length determined by the largest billet dimension to be conveyed and straightened in said casting installation.

8. A continuous billet guide stand according to claim 1, wherein said horizontal adjusting means comprises a spindle treadedly received in an elongated guiding shaft in said roller support, and a spacer member removably inserted in said lateral guide frame, said spacer member bearing against an outer end of said guiding shaft to define the retracted position of said roller support according to the width of vertical flat surfaces of a billet received in said installation.

9. A continuous billet guide stand according to claim 3 including a basic frame, and cross pieces connected between said swinging frame and said basic frame, and further including operating cylinders arranged on said basic frame and connected to said swinging frame for moving said swinging frame.

10. A continuous billet guide stand according to claim 3 including a basic frame and articulated levers connected between said basic frame and said swinging frame.

11. A continuous billet guide stand according to claim 10 wherein said articulated levers are pivoted in a parallelogram arrangement and further including a control lever which comprises a common support point with one of said articulated levers on said basic frame and is connected by a free end to an operating cylinder.

* * * * *